US006076694A

United States Patent [19]

Ragot

[11] Patent Number: 6,076,694

[45] **Date of Patent: *Jun. 20, 2000**

[54] TRASH CONTAINER INCLUDING OUTER CONTAINER

[75] Inventor: Paul-Henri Ragot, Laval, Canada

[73] Assignee: A.L.R. Envirotech Inc., Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/683,953

[22] Filed: Jul. 19, 1996

Related U.S. Application Data

[63] Continuation-in-part of application No. 08/619,440, Mar. 21, 1996.

[51] Int. Cl.[7] ..... B65D 1/00

[52] U.S. Cl. ..... 220/23.83; 220/668; 220/908; 220/812; 362/812

[58] Field of Search ..... 220/327, 662, 220/665, 908, 909, 576, 668, 812, 677, 692, 693, 23.83; 362/812

[56] References Cited

U.S. PATENT DOCUMENTS

| | | | |
|---|---|---|---|
| 550,181 | 11/1895 | Lea | 220/908 X |
| 1,380,252 | 5/1921 | Richardson | 220/908 X |
| 1,424,520 | 8/1922 | Richardson et al. | 220/908 X |
| 1,505,396 | 8/1924 | Lees | 220/910 X |
| 1,735,671 | 11/1929 | Bunker | 220/576 X |
| 1,816,974 | 8/1931 | Kavanagh | 362/812 X |
| 2,010,004 | 8/1935 | Berggren | 362/812 X |
| 3,228,736 | 1/1966 | Berkerman | 220/665 X |
| 3,334,174 | 8/1967 | Vincent | 220/668 X |
| 3,398,854 | 8/1968 | Neuberger | 220/688 X |
| 3,955,702 | 5/1976 | Lundy | 220/668 X |
| 5,662,235 | 9/1997 | Nieto | 220/909 X |

*Primary Examiner*—Steven Pollard
*Attorney, Agent, or Firm*—Swabey Ogilvy Renault

[57] ABSTRACT

A novel and ergonomic trash receptacle comprises an outer container and an inner trash can. The outer container which is mounted on a pedestal is provided with a lockable closure with the trash can being received in the container such that garbage introduced through the doors of the closure falls into the trash can. Vertical side wall assemblies are removably mounted to the container by way of extruded posts provided at the corners of the container and adapted to slidably receive the side wall assemblies. Each side wall assembly can comprise an advertisement which can be accessed, for instance, to change the advertisement or for repair purposes. The outer container or the closure can be provided with ashtrays which can discharge their contents into conduits defined in the extruded posts such as to deposit at the bottom thereof. Doors are provided to access the conduits for periodically removing the ashes and butts which have accumulated in the posts. Frame components of the outer container, i.e. the posts and cross-members, have easily removable facade sub-components for facilitating the replacement thereof, when damaged. The trash can may define multiple compartments for separately receiving, for instance, recyclable and non-recyclable items with the closure having distinct and identified doors for each compartment.

18 Claims, 17 Drawing Sheets

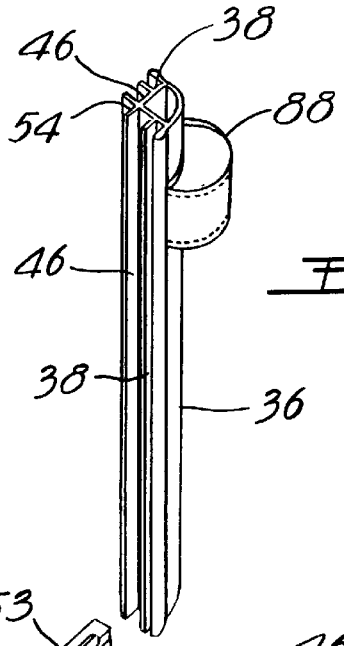
FIG. 22
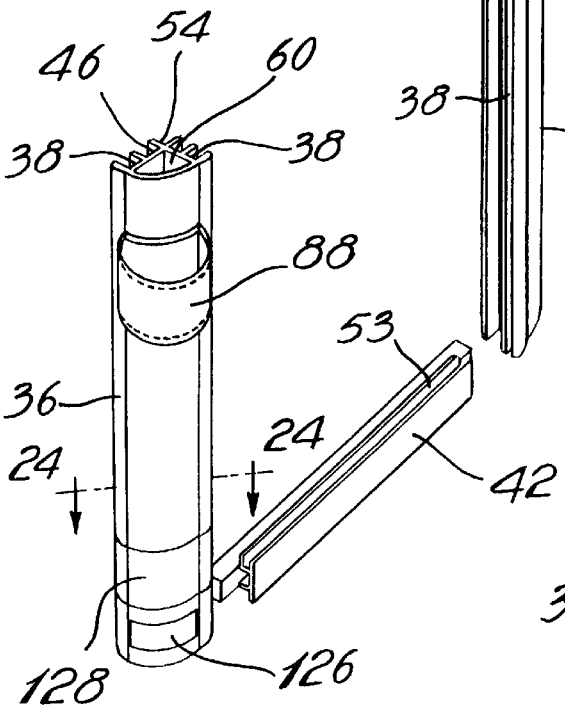
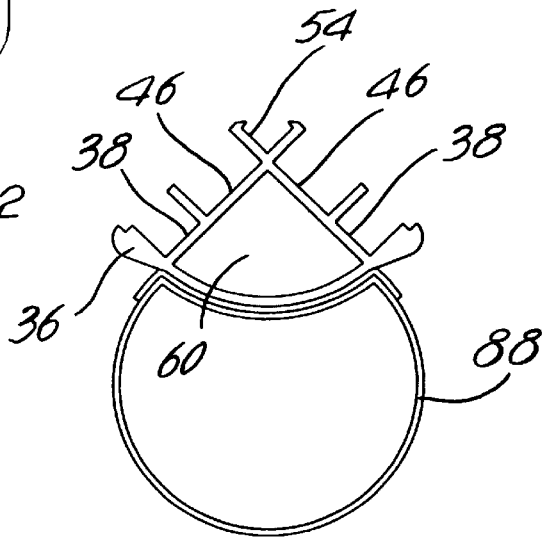
FIG. 23
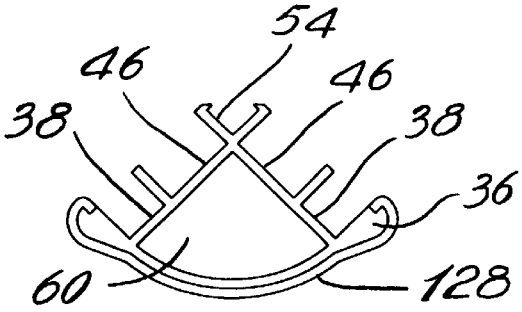
FIG. 24

TRASH CONTAINER INCLUDING OUTER CONTAINER

CROSS-REFERENCE

This application is a continuation-in-part of U.S. Ser. No. 08/619,440 filed Mar. 21, 1996.

BACKGROUND OF THE INVENTION

1. Field of the Invention

The present invention relates to trash receptacle and, more particularly, to a novel trash receptacle including an ergonomic outer container having an extruded frame and provided with a closure and a trash can disposed therein.

2. Description of the Prior Art

Obviously, trash cans are well known in the prior art, including open-ended trash cans which are used on the sidewalks of cities for public use. Such open-ended garbage containers are problematic in view of winds which might blow away garbage from the container and also in view of the possibility for people to remove the garbage therefrom thereby generating city pollution. Furthermore, direct and easy access to the contents of garbage containers is a health hazard.

There are further problems associated with the garbage containers presently used in cities, such as the visual nuisance that such containers bring about. Indeed, garbage cans contained in wire mesh outer containers or even garbage cans having wire mesh walls instead of continuous sheet metal or plastic walls are not very attractive.

SUMMARY OF THE INVENTION

It is therefore an aim of the present invention to provide a novel trash receptacle which is practical and ergonomic.

It is also an aim of the present invention to provide a trash receptacle wherein a trash can is enclosed in an outer ergonomic container having a closure.

It is a further aim of the present invention to provide a trash receptacle wherein the closure includes self-closing doors through which garbage can be inserted by the population such as to fall into the inner garbage can, and wherein the closure is displaceable with respect to the outer container such as to allow access to the garbage can contained therein by city workers for removal of the garbage can from the outer container such as to allow the garbage can to be emptied before being returned in the outer container.

It is a still further aim of the present invention to provide a trash receptacle wherein the outer container comprises a box-like housing for receiving the trash can therein and the closure at an upper end thereof, the box-like housing having vertical corner members and horizontal cross members made by extrusion and assembled in a frame-like fashion for receiving therein rectangular panels which form the vertical walls of the box-like housing.

It is a still further aim of the present invention to provide a trash receptacle wherein at least the visible surfaces of the members of the box-like housing are adapted to be easily disassembled from these members of the outer container and replaced by new corresponding components, especially with a view of facilitating the replacement of damaged components.

It is a still further aim of the present invention to provide a trash receptacle wherein the vertical panels of the box-like housing are adapted to display advertisements.

It is a still further aim of the present invention to provide a trash receptacle wherein the vertical panels of the box-like housing of the outer container are adapted to carry removable advertisements and, if so desired, illuminated advertisements.

It is a still further aim of the present invention to provide a trash receptacle provided with ashtrays which are separate from the trash can.

It is still a further aim of the present invention to provide a trash receptacle wherein the inner trash can comprises multiple separate chambers for receiving various types of litter, e.g. recyclable items versus non-recyclable trash.

It is still a further aim of the present invention to provide a trash receptacle wherein the closure is provided with multiple doors each associated with a different one of the various chambers of the trash can.

It is still a further aim of the present invention to provide a trash receptacle wherein the closure includes a concavely tapered trash receiving opening extending downwardly into the outer container.

Therefore, in accordance with the present invention, there is provided a receptacle comprising an outer housing and an inner container located in said housing, said housing defining an opening such that matter deposited therethrough is collected in said inner container, wherein said housing comprises a frame and side walls adapted to be removably mounted thereto, said frame having outer visible surfaces and being made of post means and cross member means adapted to be assembled such as to form said frame, said post means and said cross member means comprising removable outer sections defining said visible surfaces thereby allowing for the easy replacement of any damaged visible surface of said frame.

Also in accordance with the present invention, there is provided a receptacle comprising an outer housing and an inner container located in said housing, said housing defining an opening such that matter deposited therethrough is collected in said inner container, said housing comprising ashtray means distinct from said inner container.

Still in accordance with the present invention, there is provided a receptacle comprising an outer housing and an inner container located in said housing, said housing defining conduit means such that matter deposited therein is conveyed towards said inner container, said conduit means including concavely frusto-conical side wall.

Still further in accordance with the present invention, there is provided a receptacle comprising an outer housing and an inner container located in said housing, said housing defining an opening such that matter deposited therethrough is collected in said inner container, said inner container comprising at least two separate compartment means for receiving distinct types of matters.

BRIEF DESCRIPTION OF THE DRAWINGS

Having thus generally described the nature of the invention, reference will now be made to the accompanying drawings, showing by way of illustration a preferred embodiment thereof, and in which:

FIG. 6 is a cross-sectional view similar to that of FIG. 4 but showing a modified embodiment of the trash receptacle also in accordance with the present invention;

FIG. 22 is a schematic isometric view showing a pair of posts and a bottom beam of the box-like housing of FIG. 18 but with the posts being provided with another embodiment of ashtrays;

FIG. 23 is a schematic top plan view of one of the posts of FIG. 22;

FIG. 24 is a schematic cross sectional view taken along line 24—24 of FIG. 22.

DESCRIPTION OF THE PREFERRED EMBODIMENTS

Figure 1:
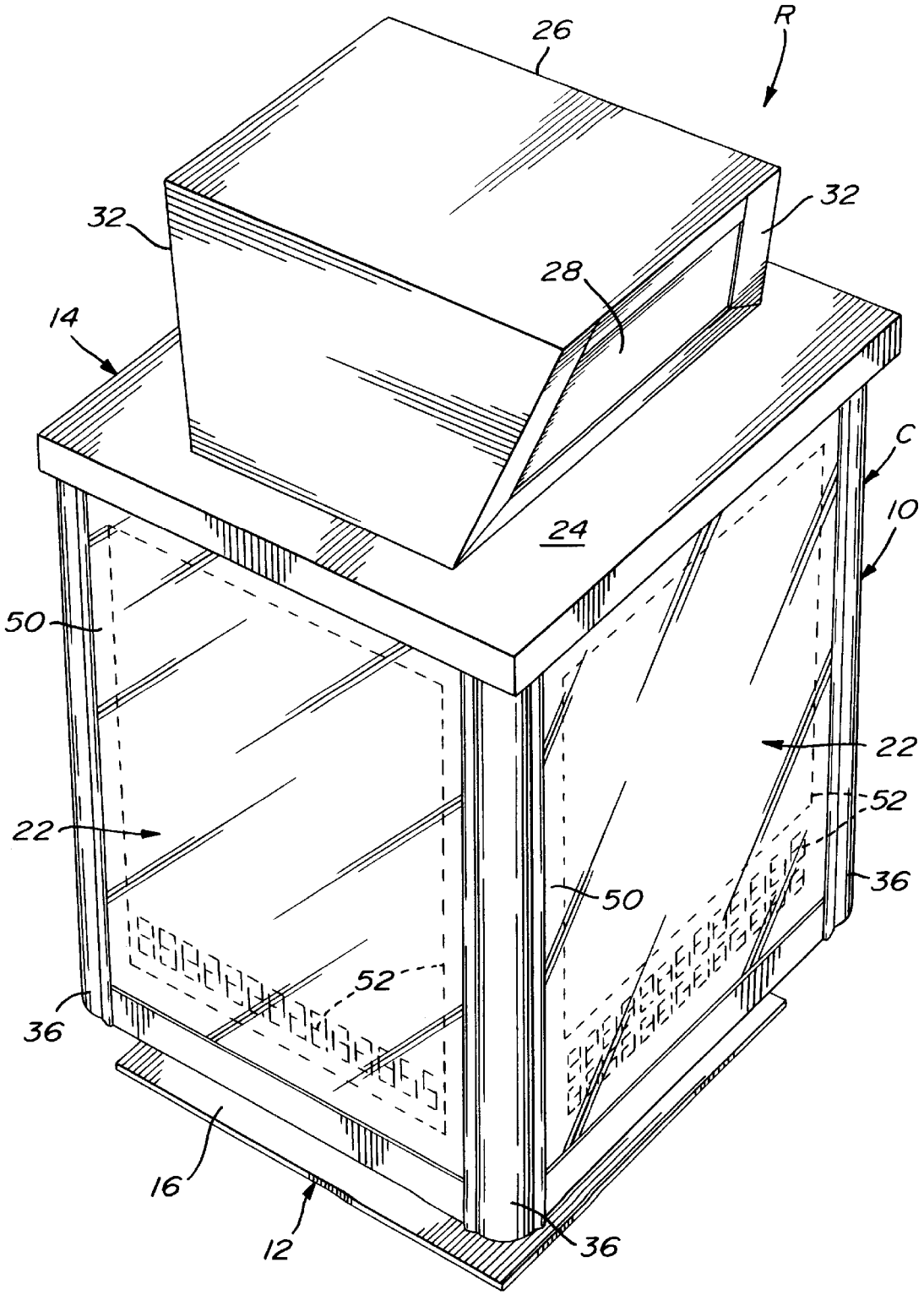
FIG. 1 is a perspective view of a trash receptacle in accordance with the present invention.
Figure 3:
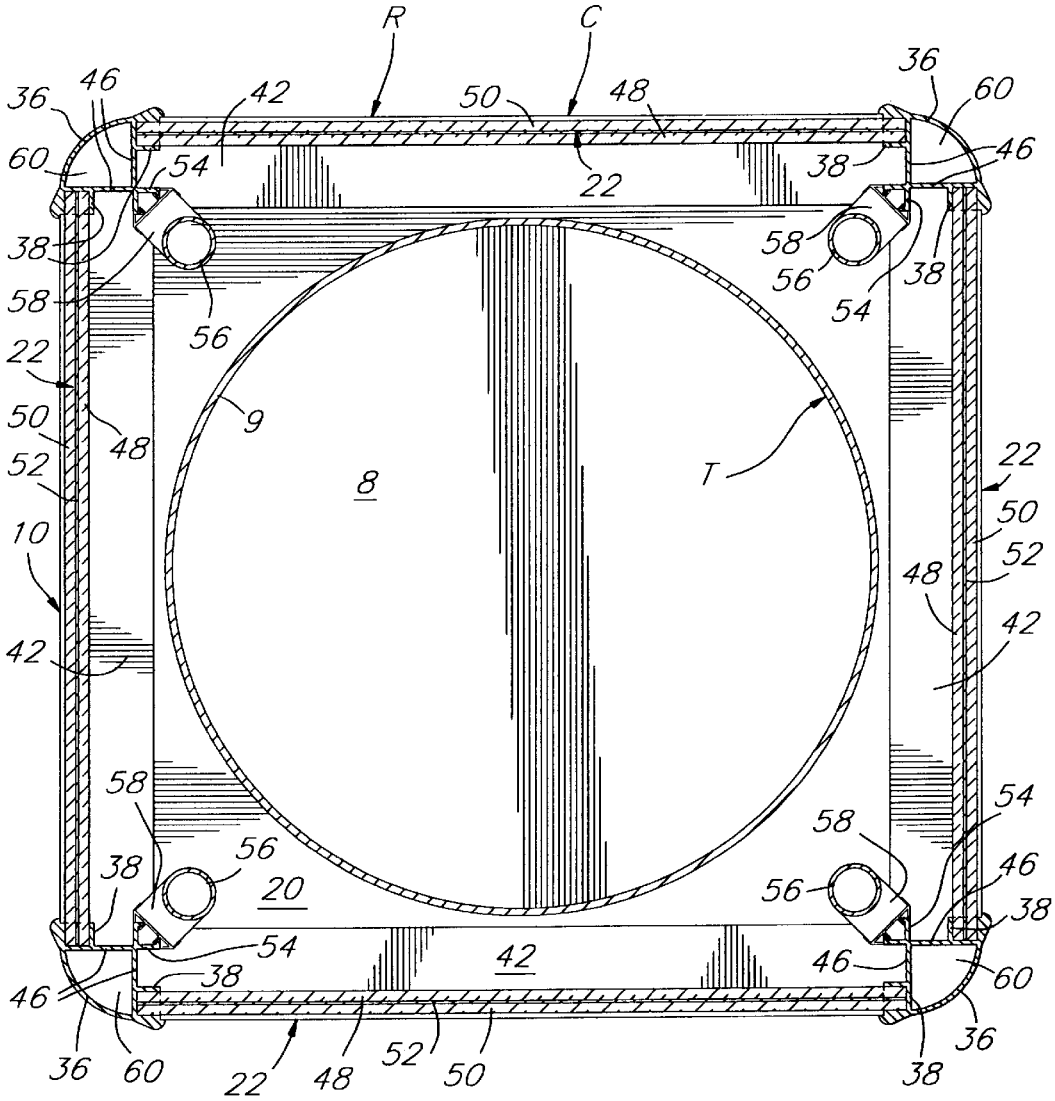
FIG. 3 is a cross-sectional view taken along line 3—3 of FIG. 2.
Figure 5:
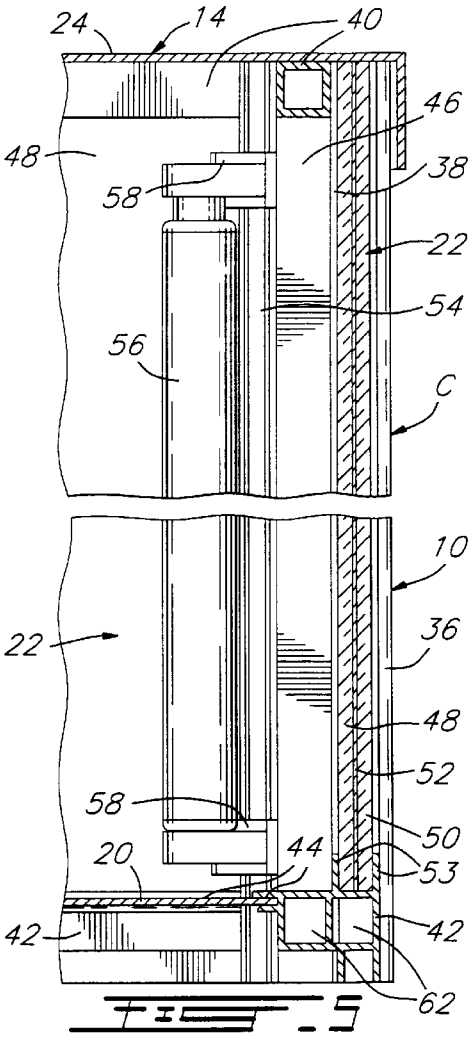
FIG. 5 is a cross-sectional view taken along line 5—5 of FIG. 4.
Figure 4:
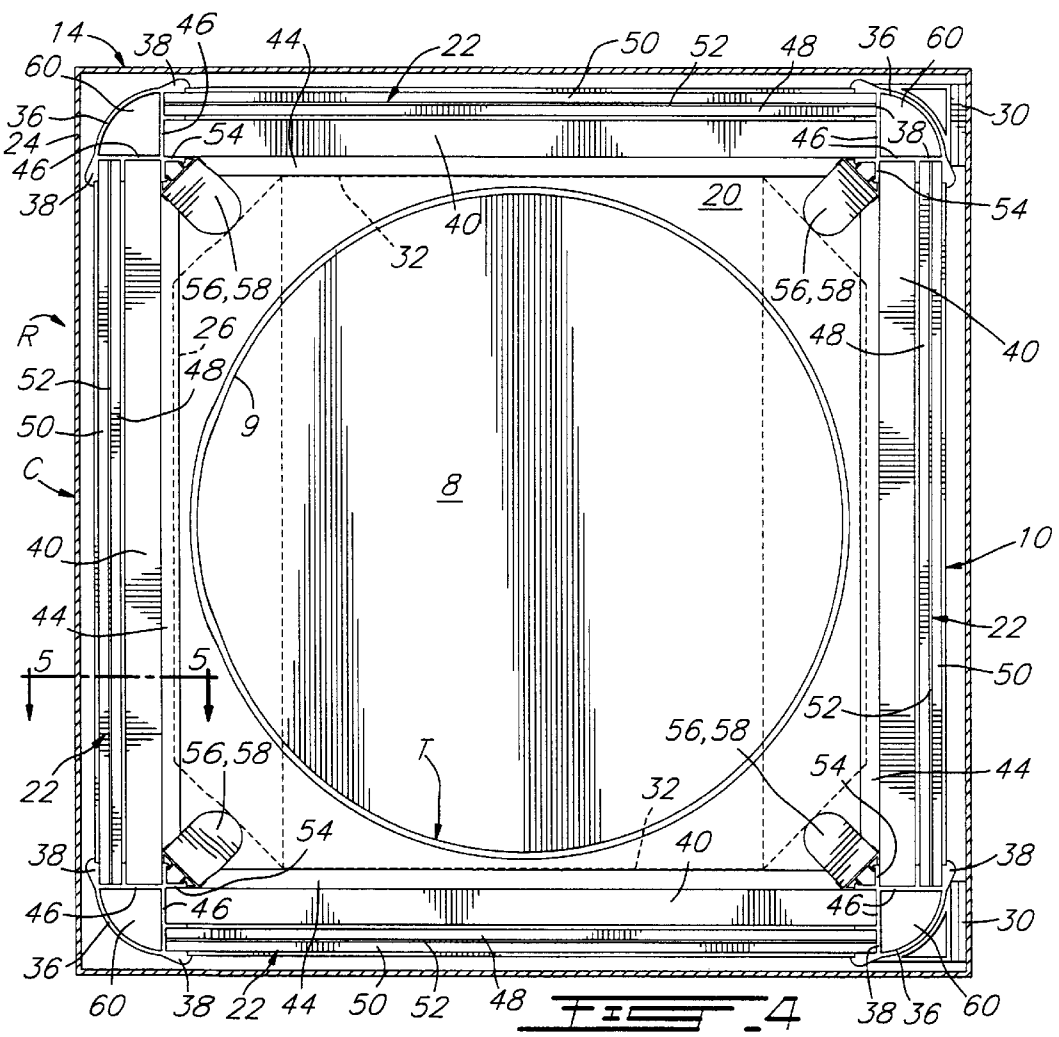
FIG. 4 is a cross-sectional view taken along line 4—4 of FIG. 2.

In accordance with the present invention, FIG. 1 shows in a perspective view a trash receptacle R which includes an outer container C and, as seen in FIGS. 3 and 4, an inner trash can T. More particularly, the trash can T is a conventional open-ended cylinder made, for instance, of a galvanized metal but which could also be made of fiberglass, PVC or other plastics materials. The trash can T has a bottom wall 8 and a cylindrical side wall 9 made with continuous sheet metal, although either one of these walls can be made as an open mesh.

The outer container C comprises a box-like housing 10 mounted on a pedestal 12 and provided at its upper end with a closure 14. In the illustrated embodiments, the pedestal 12 comprises a lower horizontal square plate 16 and an upstanding upper cylinder 18 although all sorts of geometrical shapes could be embodied in the plate 16 and in the upper member 18.

The box-like housing 10 is of the open-ended type and includes a bottom wall 20 and four composite side walls 22 extending vertically therefrom with a square-shaped horizontal profile. The closure 14 comprises a lower cover 24 which is adapted to overlie the upper ends of the composite side walls 22 of the box-like housing 10, and an upper head structure 26 adapted to receive the garbage, as described in more details hereinafter. Indeed, the head structure 26 has the shape of a box which is open-ended at its bottom and which has a pair of self-closing gravity doors 28 mounted at opposed side walls thereof, in an inclined fashion, and adapted, when garbage is introduced in the closure 14 by way of the doors 28 to allow the garbage to fall through the open end at the bottom of the head structure 26 and through an inner opening defined in the cover 24 inwardly of the side walls 22 of the head structure 26 and into the trash can T.

Figure 2:
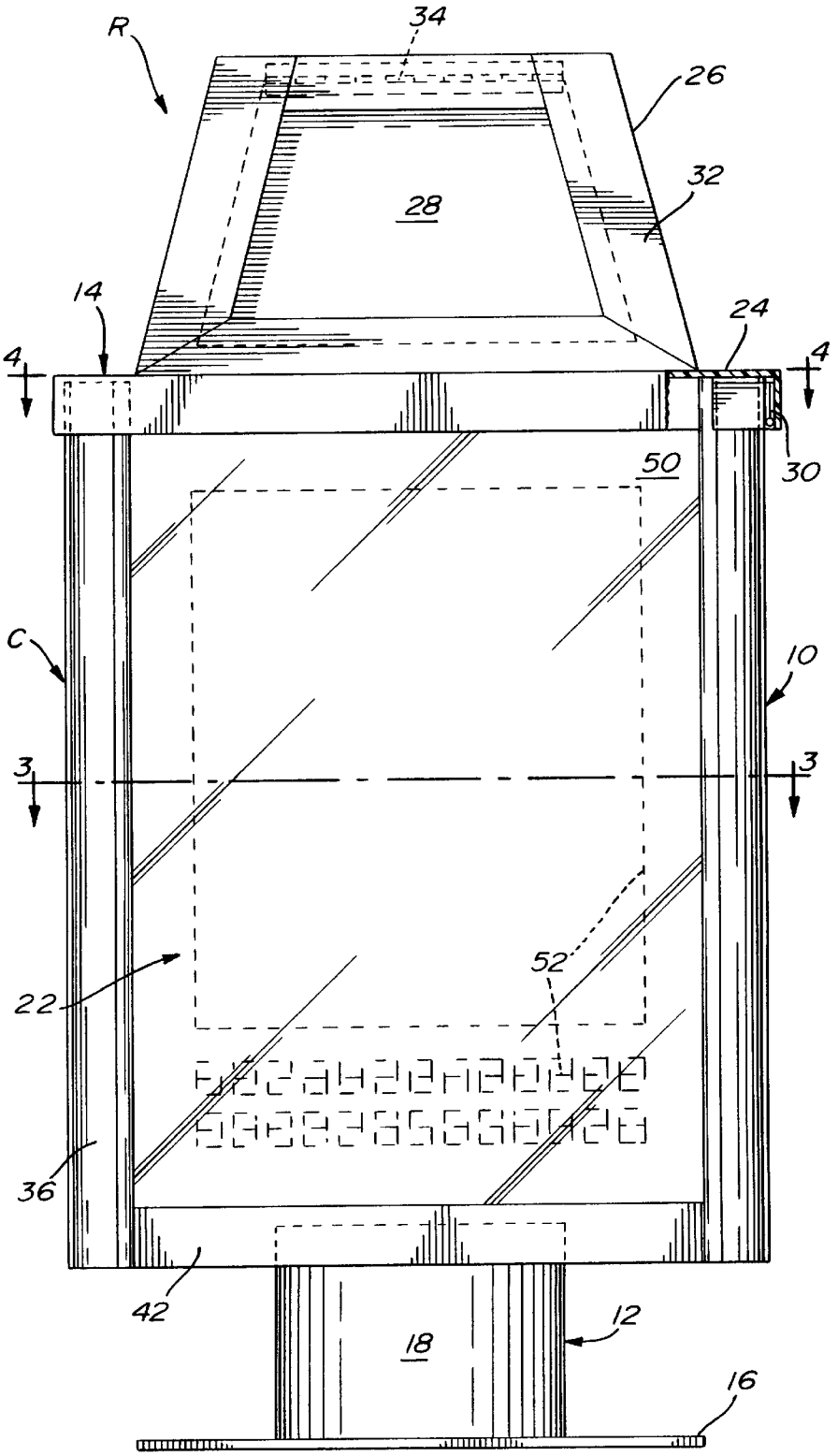
FIG. 2 is a front elevational view, shown in cross-section where fragmented, of the trash receptacle of FIG. 1.

As seen in FIGS. 2 and 4, the closure 14 is pivotally mounted at its cover 24 to the upper end of one of the composite side walls 22 of the box-like housing 10 by way of hinges 30. A lock mechanism (not shown) can be provided to secure the closure 14 onto the box-like housing 10 in the position shown throughout the drawings such as to allow only city workers to pivotally lift the closure 14 about the hinges 30 for accessing the trash can T and, more particularly, for removing the same from the outer container C to empty the trash can T before it is returned into the outer container C.

As best seen in FIG. 1, the doors 28 are mounted on opposed side walls 32 of the head structure 26 which are inclined inwardly from top to bottom with the doors 28 being mounted inwardly of these side walls 32 by way of overhead hinges 34 (see FIG. 2), whereby the doors 28, at rest, are always in the closed position thereof illustrated in FIGS. 1 and 2 in view of the gravity forces which act thereon, wherein garbage is inserted through the openings defined in the side walls 32 by pushing onto the doors 28 which pivot inwardly and upwardly within the head structure 26 of the closure 14 and against the limited gravity forces acting on these doors 28, until the garbage falls freely into the trash can T and the user removes his/her hand from within the head structure 26 thereby allowing the previously opened door 28 to return to its closed position, again by way of gravity.

It is noted that the closure 14 can take on various other shapes and proportions. For instance, all of the side walls 32 of the head structure 26 could be inclined and could all possibly be provided with a door 28. Depending on the number of sides of the box-like housing 10, the shapes of the cover 24 and of the head structure 26 will be accordingly modified. Furthermore, the present trash receptacle R can also be used without its closure 14, or with only its cover 24 and not its head structure; in both cases, the trash receptacle R is of the open-ended type, i.e. without any doors therefor.

Also, the opening of the doors 28 could be made automatic by way, for instance, of a sensor which would detect the presence of a person's hand and/or garbage when in close proximity to the doors 28. Electricity for this sensor could be readily available from a power source already present in the trash receptacle R for its illumination which is described hereinafter.

Now turning to the box-like housing 10, it is noted that the composite side walls 22 are vertically mounted by way of four extruded corner posts 36 each defining a pair of vertical side channels 38 adapted to receive the vertical sides of a pair of successive composite side walls 22. Slightly rearwardly of the composite side walls 22, upper and lower horizontal beams 40 and 42, respectively, which are preferably made by extrusion extend between each pair of adjacent posts 36 and are assembled thereto. The bottom wall 20 of the box-like housing 10 is also peripherally engaged with a horizontally extending inner groove 44 defined in the lower beams 42. The posts 36 define further vertical side channels 46 which receive the ends of the upper and lower beams 40 and 42 to form with the posts 36 four solid rectangular frames for the box-like housing 10 to which are mounted the composite side walls 22 and the bottom wall 20.

Each composite side wall 22 is, in the illustrated embodiments, made up of inner and outer rectangular panels 48 and 50, respectively, and an intermediate panel or sheet 52 disposed between the inner and outer panels 48 and 50. The inner and outer panels 48 and 50 and the intermediate sheet 52 are disposed in a sandwich-like configuration and are received at their vertical side ends into the aforementioned channels 38 of the corner post 36 while the lower horizontal ends thereof are received in an upper channel 53 defined in the lower beam 42.

More particularly, the inner panels 48 can be opaque, whereas the outer panels 50 can be made in a translucent material, such as Mica, with the intermediate sheet 52 being, for example, a cardboard advertisement which can thus be viewed from the outside and through the outer panel 50 by pedestrians and motorists. Also, by unlocking the closure 14 from the box-like housing 10, the composite side walls 22 and, more particularly, the inner and outer panels 48 and 50 and the intermediate advertisement sheet 52 can be slidably removed from engagement with the corner posts 36 by vertically and translationally displacing the side wall assemblies 22 thereby allowing the intermediate sheet 52 to be replaced by another similar sheet showing possibly a different advertisement or allowing for a damaged outer panel 50 to be replaced.

Furthermore, each corner post 36 can define between the channels 46 thereof another channel 54 to which a lighting unit 56, such as a fluorescent light tube, can be vertically mounted using a pair of brackets 58 engaged to the channel 54. The wiring (not shown) for the lighting units 56 can run through raceways in the form of conduits 60 and 62 defined respectively in the extruded corner posts 36 and in the extruded lower beams 42. The power supply for the lighting units 56 is not shown and it is noted that a solar energy system could be used.

Once such lighting units 56 are used, the inner panels 48 are typically also made, as are the outer panels 50, of a translucent material such as to illuminate from behind (i.e. back-lighting) the intermediate advertisement sheet 52. The inner panels 48 may be made of a thinner material which allows for the light emanating from the lighting units 56 to efficiently illuminate the intermediate advertisement sheets 52, whereas the outer panels 50 will normally be made of a more resistant and sturdier material for sustaining outside elements, e.g. climate-related and vandalism-related abuse as well as standard wear factors. Furthermore, in such an illuminated application, the advertisement sheet 52 is made of a translucent film (which is well known in the art), instead of cardboard, in order to accentuate the effect of the light emanating from the lighting unit 56 such that the advertisement on the intermediate sheet 52 has more impact.

Figure 7:
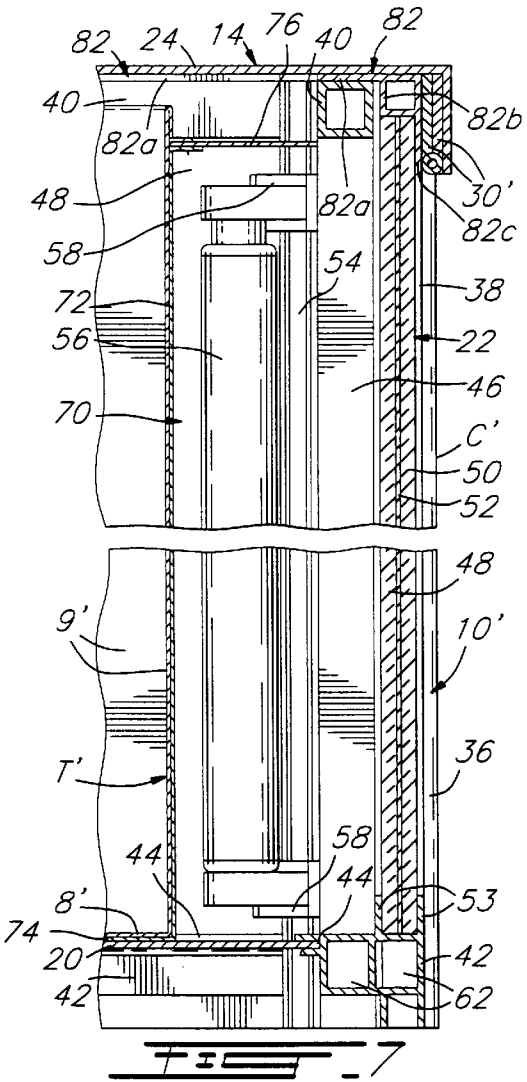
FIG. 7 is a cross-sectional view taken along line 7—7 of FIG. 6.

FIGS. 6 and 7 illustrate a variant R' of the trash receptacle R of FIGS. 1 to 5. More particularly, the trash receptacle R' includes a trash can T' having a square horizontal cross-section surrounded by a fire wall 70 extending in the outer container C' between the lighting units 56 and the trash can T'. The fire wall 70 is shaped as a square container having an out-turned horizontal flange and, more particularly, the fire wall 70 comprises a peripheral upstanding side wall 72 located between the lighting units 56 and the trash can T', a bottom wall 74 extending horizontally within the lower edges of the side wall 72 while being sandwiched between the bottom wall 8' of the trash can T' and the bottom wall 20 of the outer container C', and rectangular outwardly extending horizontal upper flanges 76 which depend from the upper edges of each side panel of the side wall 72. The fire wall 70 is required to prevent the heat generated by the lighting units 56 from causing flammable articles located in the trash can T' from igniting and also to prevent any fire in the trash can T (for instance, as a result of a lit cigarette butt being thrown therein) from damaging the outer container C', especially if the latter is made of a plastics material. The fire wall 70 could also be used with the cylindrical trash can T of FIGS. 1 to 5.

The trash can T' is provided with a pair of handles 78 for facilitating the removal thereof from the outer container C' (and also its return therein) and with a pair of chains 80 extending between a pair of opposite ones of the upper beams 40 and the closure 14 for limiting the pivot of the closure 14 way from the outer container C' when access to the latter is required (for emptying the trash can T' or for changing the advertisement sheet 52) up to a position (not shown) where the closure 14 is at an obtuse angle with respect to the outer container and is thus in a stable, gravity-induced but chain-limited, open position. The closure 14 is herein pivotally mounted to the upper beams 40 of the box-like housing 10' by way of a full length piano hinge 30'.

It is contemplated to use, instead of the chains 80, a locking hinge which would retain the closure 14 in its open position until some force is applied thereto against the mechanical and/or frictional locking mechanism of such a hinge. Also, small air cylinders could be used for the closure 14, such as smaller versions of those found on "hatchback" vehicles.

In order to prevent city workers in charge of emptying the trash can T' (and also the population at large when the trash receptacle R or R' is used without a locked closure 14) from tampering with the removable panels 48, 50 and 52 of each composite side wall 22, a locking member 82 is mounted atop each composite side wall 22 (i.e. above the panels thereof) and the upper beam 40 and extends horizontally between the corner posts 36. More particularly, the locking member 82 includes an upper plate **82*a*, a bar 82*b* and a protective front flange 82***c*. The bar 82*b* extends above the upper ends of the panels 48, 50 and 52 (see FIG. 7) and horizontally between the corner posts 36 while having its ends in the channels 38 thereof. The front flange 82*c* denies easy access to the upper ends of the panels 48, 50 and 52 when the closure 14 is open or when there is no closure on the box-like housing 10. Each locking bar 82 is removably secured to the upper beam 40 with tamper-proof screws 84 extending through the upper plate 82*a* and the upper beam 40 such as to permit only authorized personnel to access the panels 48, 50 and 52.

It is noted that, for both embodiments, the pedestal 12 could be rotatable about a vertical axis thereof such that a motorized mechanism provided with a timer could cause for the whole trash receptacle R, R' to be rotated a given angle every predetermined period of time such as to expose a different side of the box-like housing 10, 10'. Indeed, if various advertisements appear (at the sheets 52) on the different faces of the receptacle R, R', it might be useful or necessary to rotate, for instance every three or four hours, the trash receptacle R, R' about pre-selected angle which could typically correspond to 360° divided by the number of sides or faces of the box-like housing 10, 10' and, in the case of the illustrated embodiments, this angle would thus be 90° thereby exposing each face in each of four general directions for a preset period of time.

In the above embodiments of the trash receptacle of the present invention, the extruded components are made of aluminum although plastics materials could also be used while the remaining components can be made of suitable metallic or plastics materials, except for the panels 48, 50 and 52 which, at least in the case of back-light illumination thereof, are made of appropriate plastics or plastic-like materials (or other suitable transparent materials, e.g. glass, fiberglass, etc.). Even wood or wood-like products could be used for most components of the trash receptacle.

Figure 8:
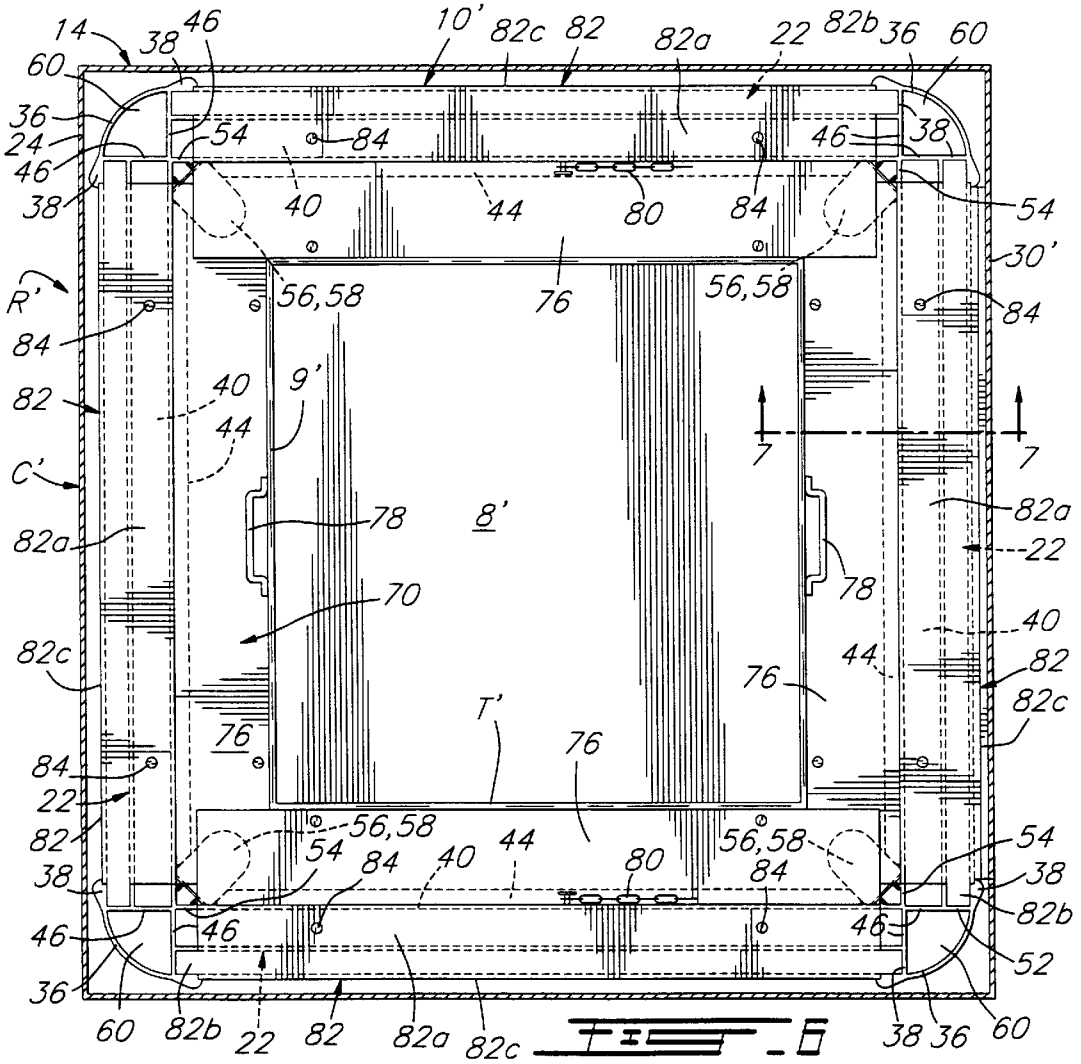
FIG. 8 is a schematic isometric view similar to FIG. 6 but showing a variant closure and ashtrays disposed on the vertical corner posts of the outer container.
Figure 8:
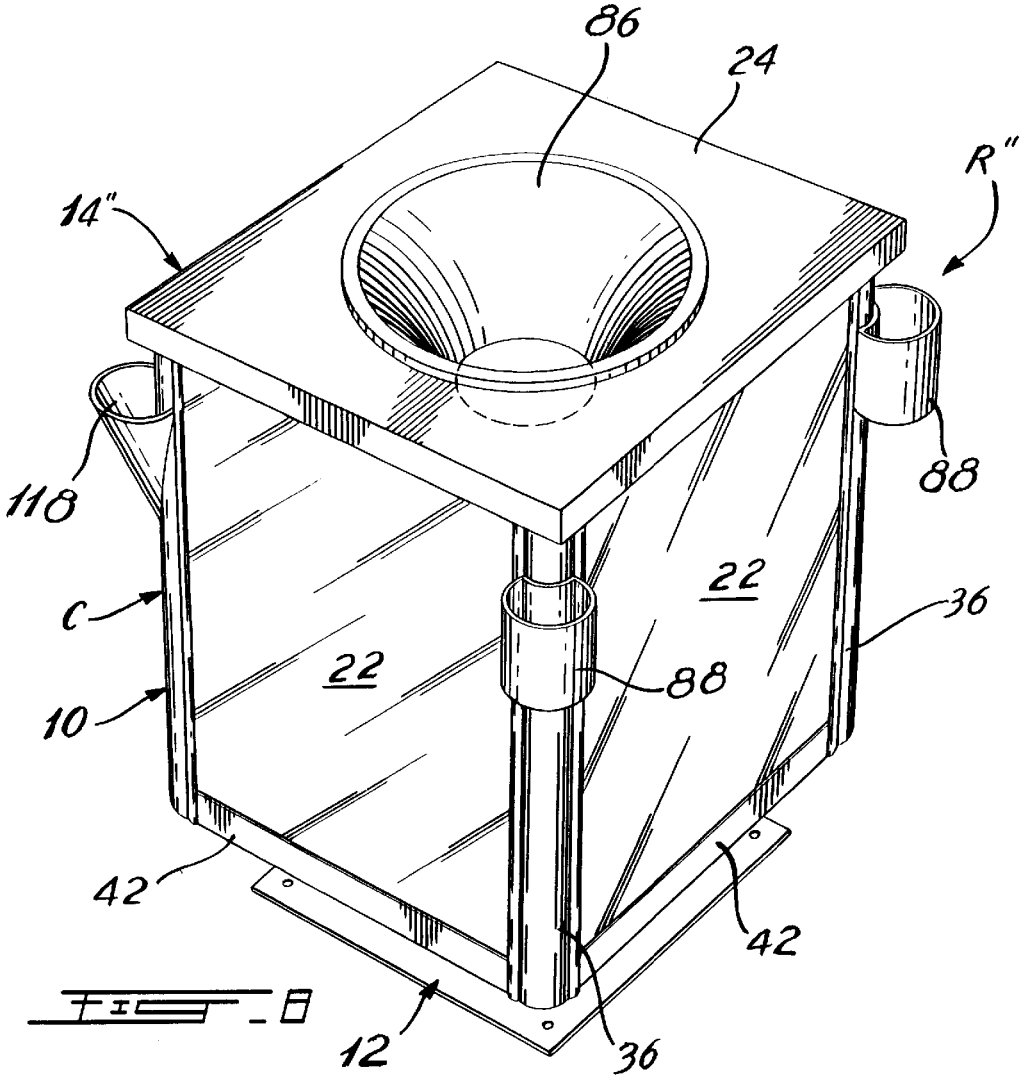

FIG. 8 illustrates a trash receptacle R" which is similar to either one of the trash receptacles R and R' of FIGS. 1 to 5 and FIGS. 6 and 7 respectively, although the trash receptacle R" includes a different closure 14" which sits atop the outer container C. The closure 14" defines a central opening with a neck-shaped conduit 86 extending downwardly therefrom such that trash deposited therein falls into the trash can T. More particularly, the conduit 86 has the shape of an inverted bell or of a concave-walled frustum and more precisely the shape of the upper half of a one-sheet hyperboloid which is cut through its diametrical plane extending through its center. This shape limits the entry of air in the trash receptacle R" and this impedes the propagation of any fire taking place in the trash receptacle R".

The trash receptacle R" of FIG. 8 also comprises on each post 36 of the box-like housing 10 of the outer container C an ashtray 88 which includes a removable inner container for receiving ashes and cigarette butts and which can be removed for emptying thereof.

Figure 9:
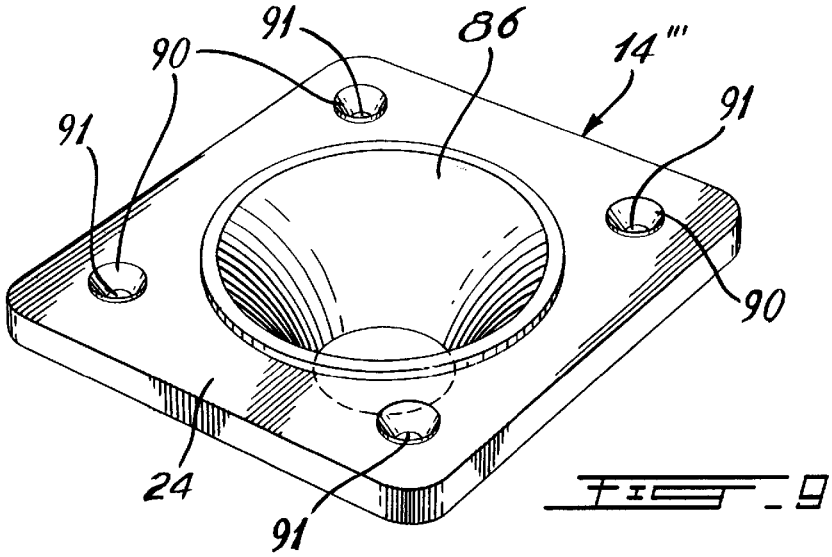
FIG. 9 is a schematic isometric view of a variant of the closure of FIG. 8.

FIG. 9 illustrates a closure 14'" similar to the closure 14" of FIG. 8 but provided with ashtrays 124 (shown in FIG. 21) removably embedded in the upper surface of the closure 14'" and provided thereon with removable conical ashtray covers 90 which define a bottom aperture 91 such that ashes and cigarette butts deposited in the ashtray covers 90 fall through the apertures 91 and into the ashtrays 124 which are partly filled with sand, or the like. The ashtray covers 90 thus conceals the ashes and butts contained in the ashtrays 124 and are thus preferably provided with a decorative finish, such as chrome plating. The ashtray covers 90 are fixed, for instance by a hidden steel wire (not shown) to the closure 14'" in order to prevent the theft thereof.

Figure 10:
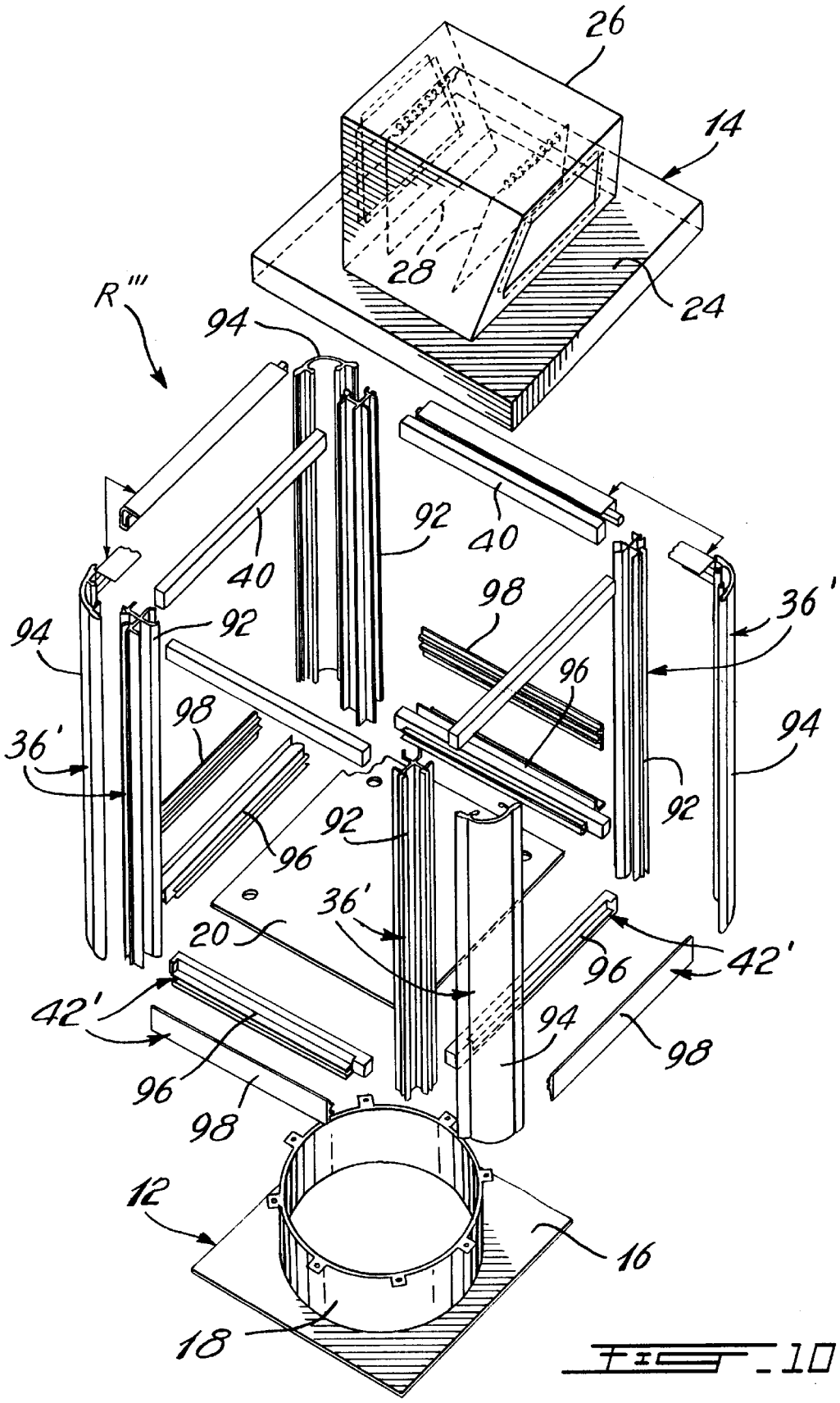
FIG. 10 is an exploded isometric view of another trash receptacle which is a variant of FIG. 6, wherein there are shown the variant trash receptacle's outer container, upper closure and pedestal with visible surfaces of the outer container being embodied in easily replaceable components and wherein the composite side walls of the outer container, the inner trash can, the lighting units and the fire wall are not shown.

FIG. 10 illustrates another embodiment of a trash receptacle R'" similar to the trash receptacle R' of FIGS. 6 and 7 but having modified posts 36' and lower beams 42' in the construction of the box-like housing of its outer container. More particularly, the modified posts 36' and lower beams 42' instead of each being constructed in a single extrusion are each made of at least two components, namely a structural component and a decorative facade. Indeed, each post 36' includes a structural extrusion 92 and an outer decorative extrusion 94 removably assembled thereto. Similarly, each lower beam 42' includes a structural extrusion 96 and a outer decorative extrusion 98 removably mounted thereto.

Figure 11:
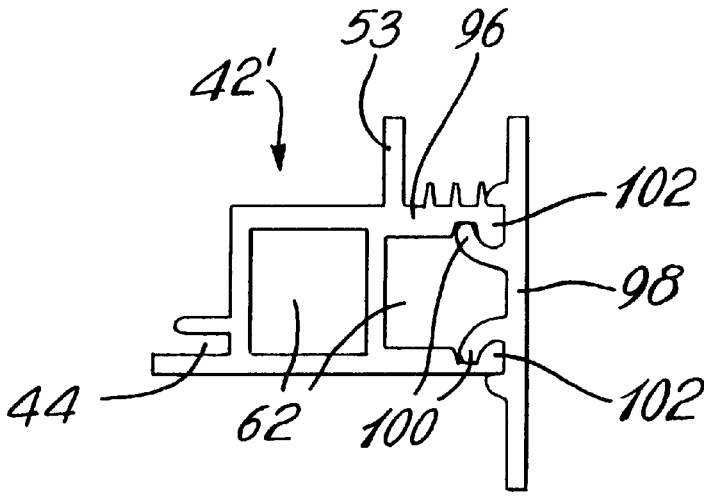
FIG. 11 is a schematic side elevational detail view of the lower beams of the box-like housing of the outer container.
Figure 12:
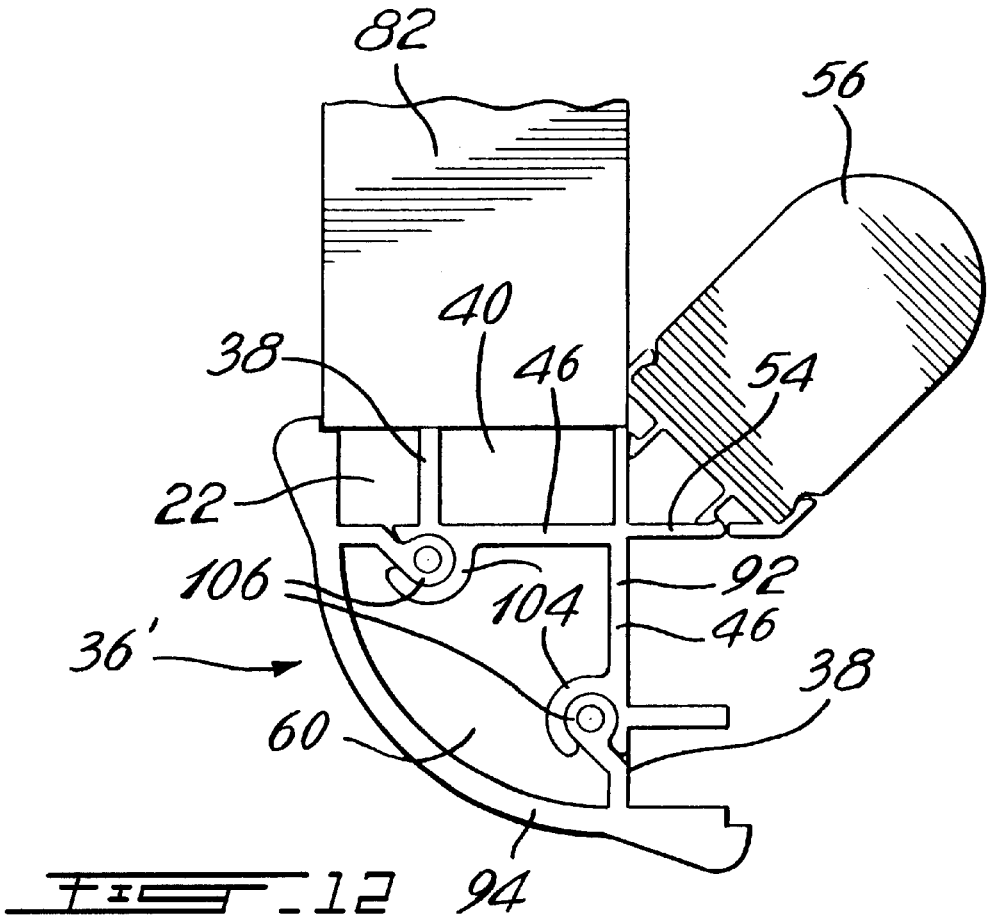
FIG. 12 is a schematic top plan detail view of the posts of the box-like housing of the outer container.

FIGS. 11 and 12 show enlarged detailed views of the modified post 36' and lower beams 42', respectively. As well seen in FIG. 11, the decorative extrusion 98 of the lower beam 42' includes a pair of flared arms which are engaged ehind inwardly projecting hooks 102 defined by the structural extrusion 96. As for the post 36', as seen in FIG. 12, the structural extrusion 92 defines a pair of longitudinal substantially keyhole-shaped sheaths 104 with the decorative extrusion 94 comprising a pair of inwardly projecting arms which terminate in enlarged cylindrical hems 106 which are slidably engageable in the sheaths 104. Rivets or screws (not shown) can be engaged longitudinally into the upper ends of the hems 106 in order to secure the same two sheaths 104 of the structural extrusion 92 such as to prevent the decorative extrusion 94 from sliding down along the fixed structural extrusion 92 by way of gravity forces.

Figure 13:
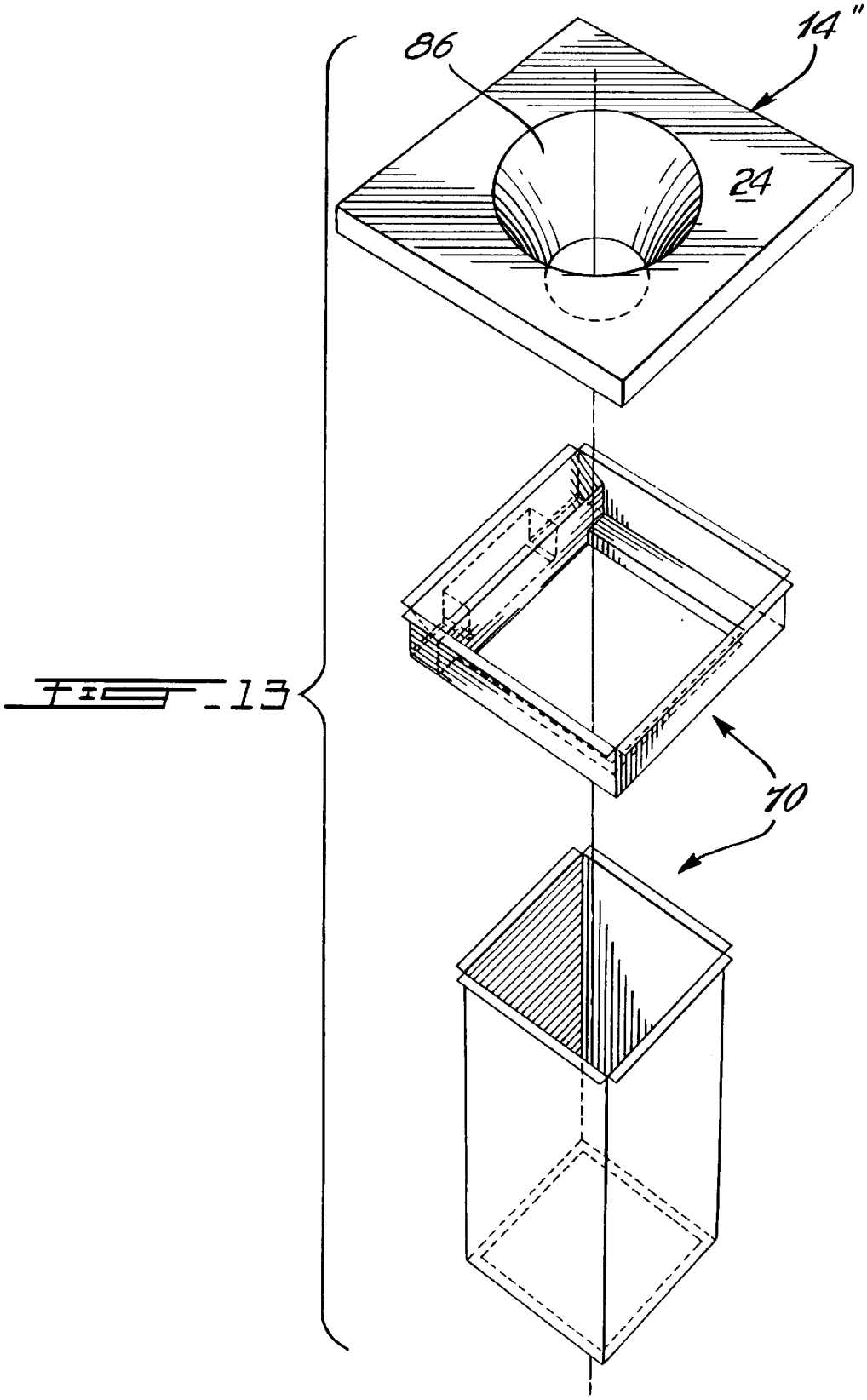
FIG. 13 is a schematic exploded view showing the two fire wall units for the trash receptacle of FIG. 10 and showing an alternate closure therefor.

FIG. 13 illustrates the two-part fire wall 70 for use with the trash receptacle R'" of FIG. 10 with FIG. 13 also showing the closure 14" of FIG. 8 for use on the trash receptacle R'" of FIG. 10 instead of the closure 14 illustrated in FIG. 10.

Figure 14:
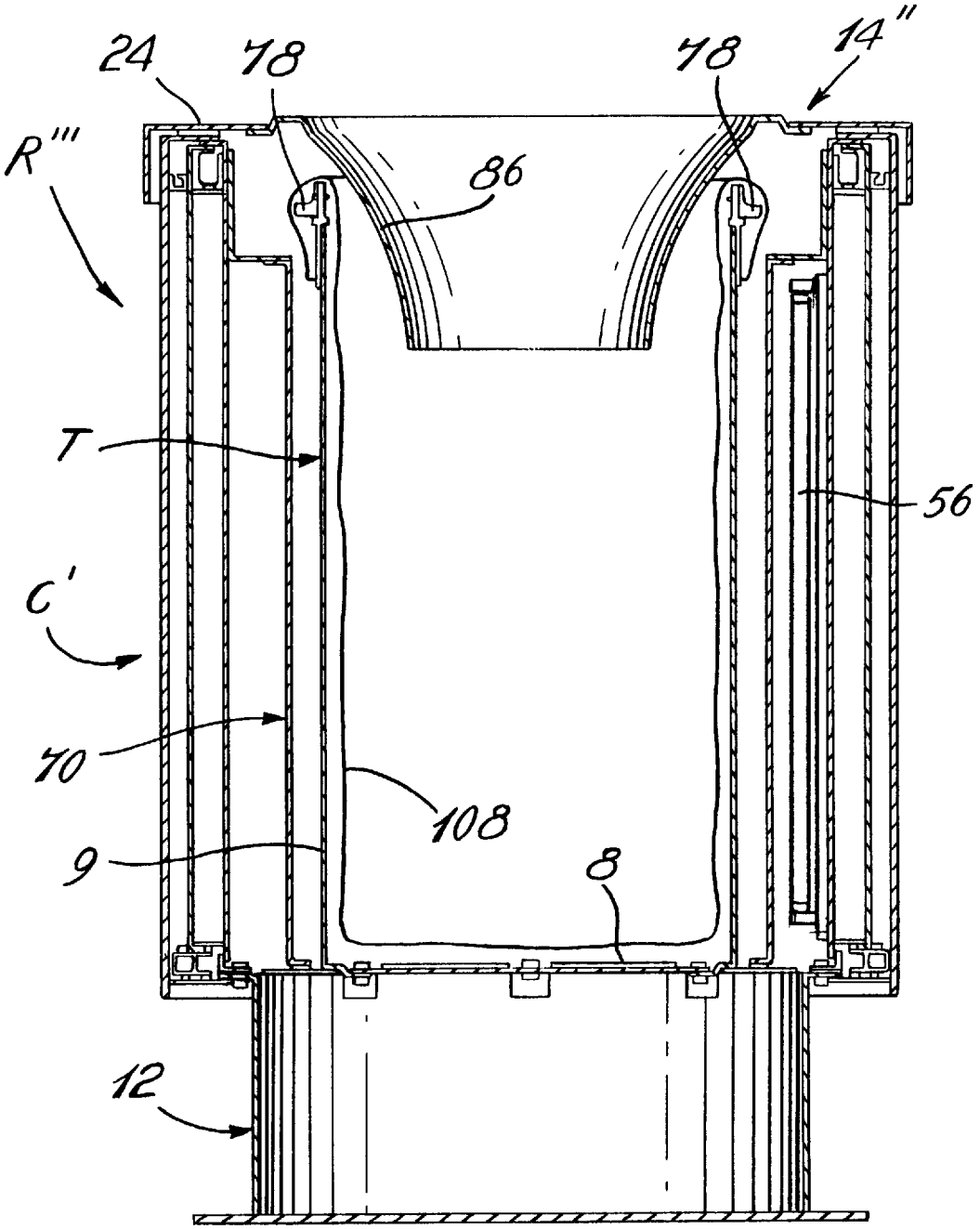
FIG. 14 is a schematic vertical cross section of the trash receptacle of FIGS. 10 and 13, as assembled, and further showing the inner trash can and a plastic bag therein.

FIG. 14 shows, in an assembled state, the trash receptacle R" of FIGS. 10 and 13 using the closure 14" of FIG. 13 with the trash can T being positioned in the outer container C and with a plastic bag 108 being suspended in the trash can T.

Figure 16:
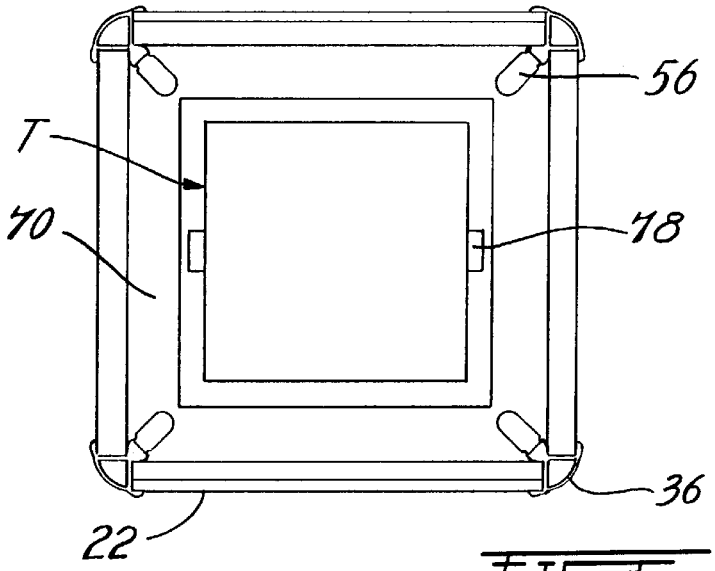
FIG. 16 is a schematic top plan view of the trash receptacle of FIG. 15 but without its closure for illustration purposes.
Figure 15:
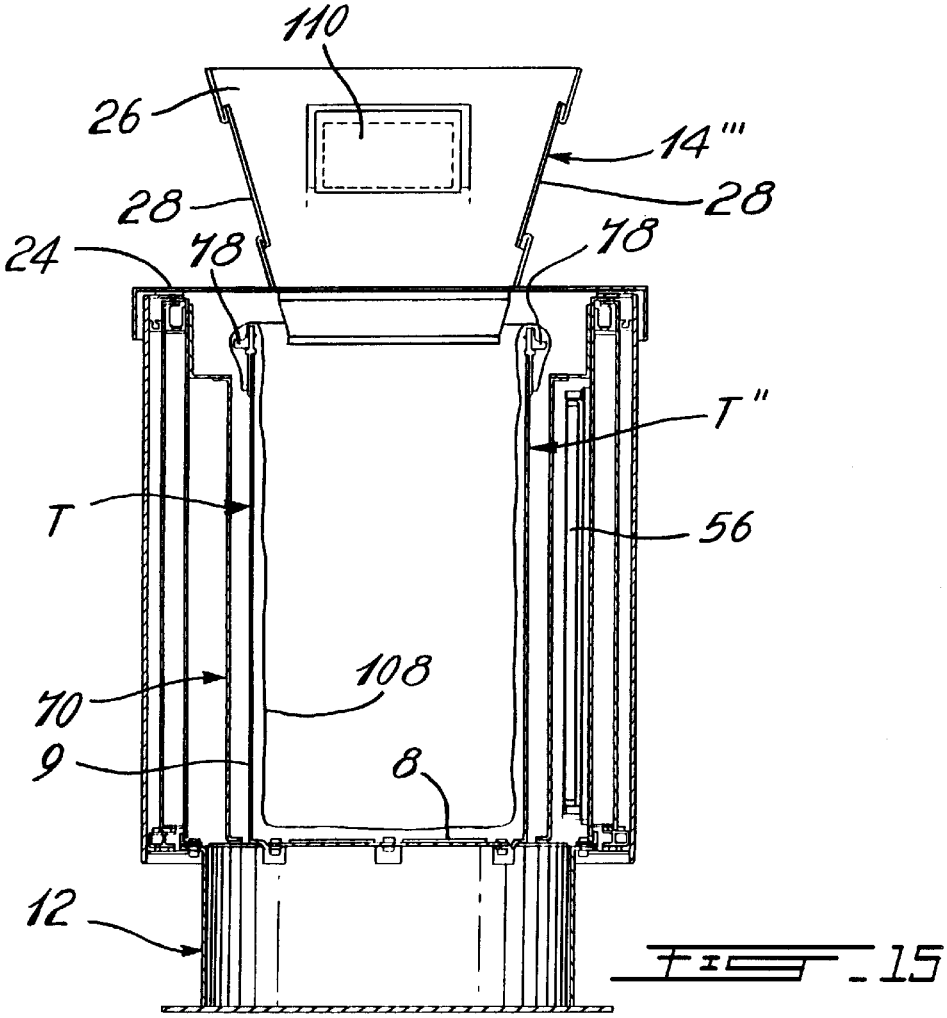
FIG. 15 is a schematic vertical cross section of another trash receptacle in accordance with the present invention.
Figure 17:
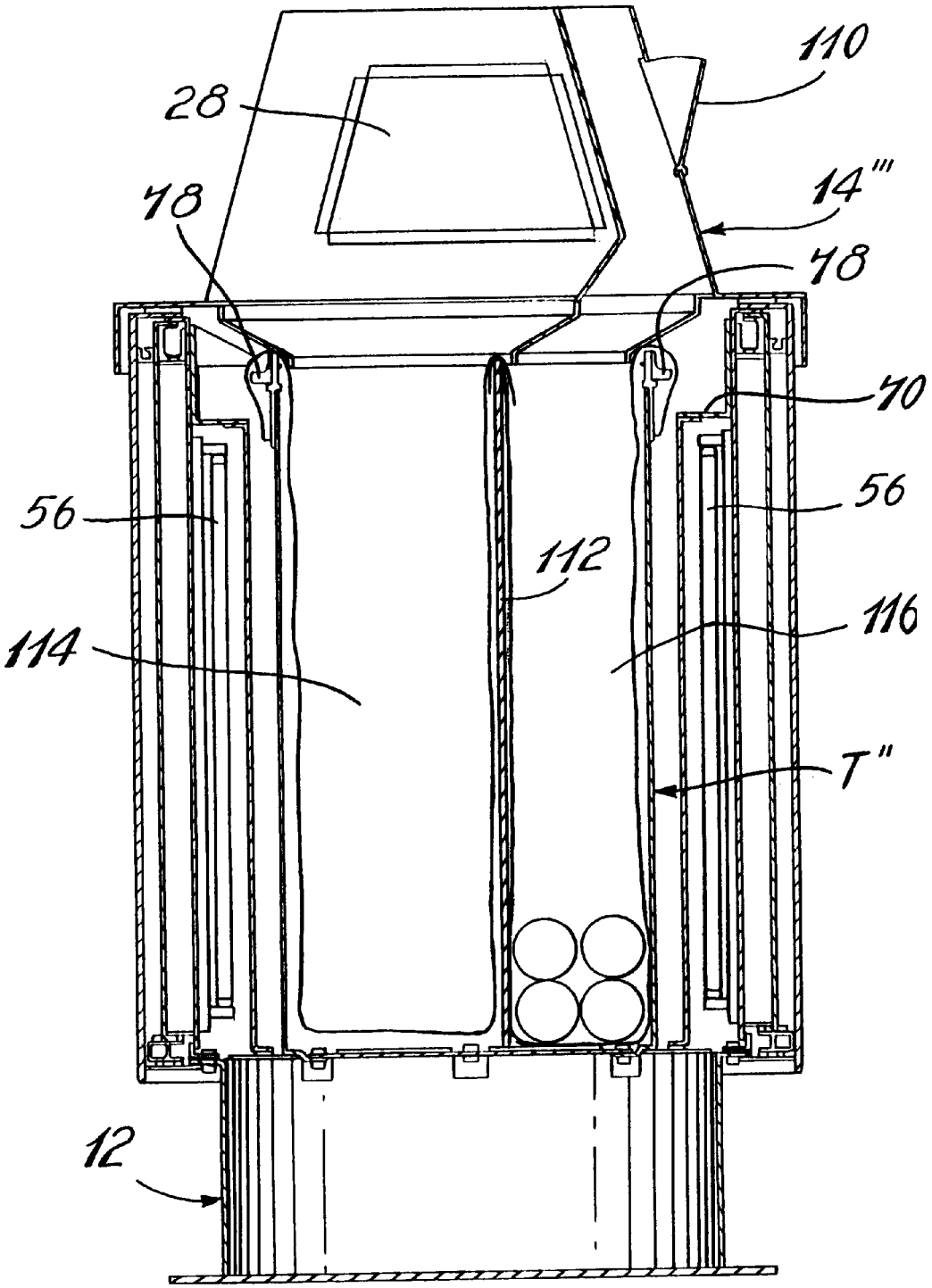
FIG. 17 is a schematic vertical cross section of still another trash receptacle in accordance with the present invention, wherein the inner trash can is provided with a pair of distinct chambers.

FIGS. 15 to 17 illustrate a trash receptacle similar to that of FIG. 14 but wherein there are provided a variant closure 14'" which has an additional door 110 and a modified trash can T" which, as best seen in FIG. 17, comprises a partition 112 thereby forming two distinct chambers 114 and 116 in the trash can T". In the illustrated embodiment, the chamber 116 is adapted to receive recyclable items, such as cans, and is in communication with the door 110 such that items deposited through the door 110 are received in the chamber 116. Items deposited through either one of the two standard side doors 28 end up in the container 114 which typically is intended for disposable trash.

Figure 18:
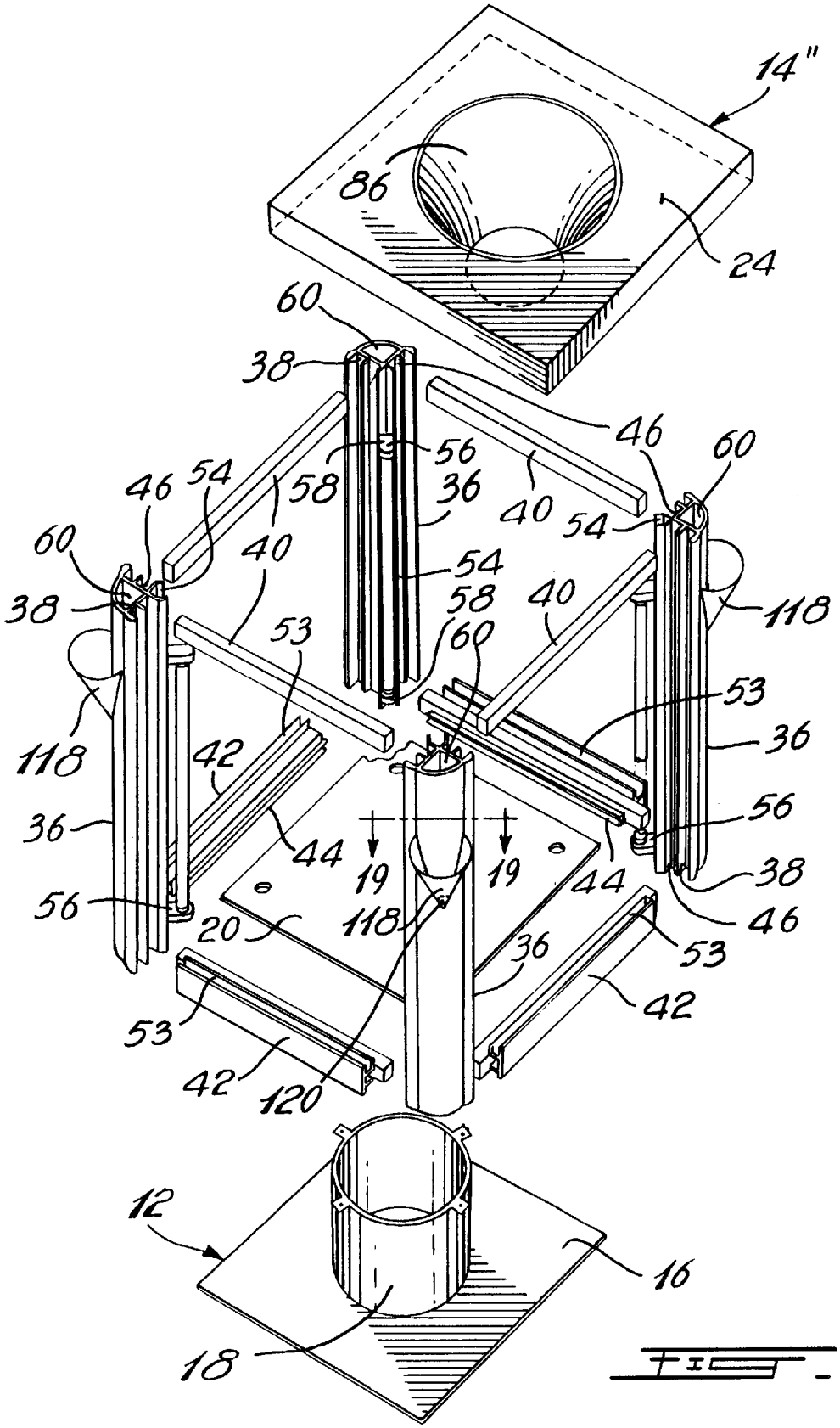
FIG. 18 is a schematic isometric exploded view of still another trash receptacle, similar to FIG. 8 but with variant ashtrays.

FIG. 18 is similar to FIG. 8 but the trash receptacle R" is provided at its posts 36 with conical ashtrays 118. An opening 120 is defined in each post 36 opposite an open bottom portion of the conical ashtray 118 such that ashes and cigarette butts deposited in the ashtray 118 go through the opening 120 and into the conduit 60 defined by the post 36 and deposit at the bottom of the post 36. A door is provided at the bottom of the post 36 such as to allow, for instance, a city worker to remove the ashes and cigarette butts and thus periodically empty the posts 36.

Figure 19:
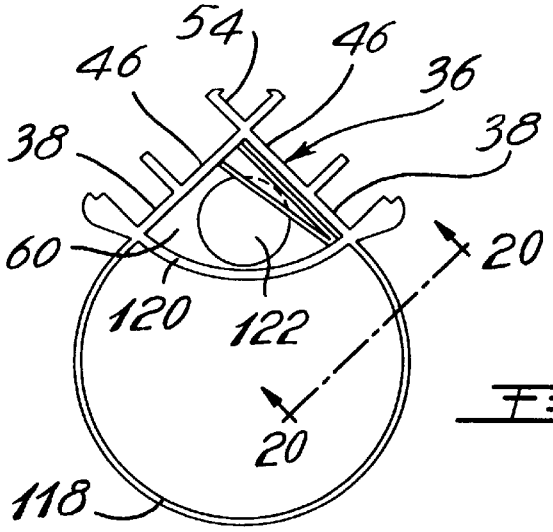
FIG. 19 is a schematic cross sectional view taken along line 19—19 of FIG. 18.
Figure 20:
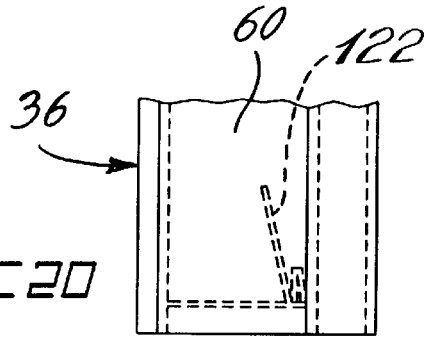
FIG. 20 is a schematic cross sectional view taken along line 20—20 of FIG. 19.

FIGS. 19 and 20 illustrate a gravity door 122 (which can also be spring loaded) located at the bottom of each post 36 such that when a vacuum hose is inserted therethrough, from the bottom of the post 36, the door 122 opens and the ashes and cigarette butts are removed by vacuum from the post 36.

Figure 21:
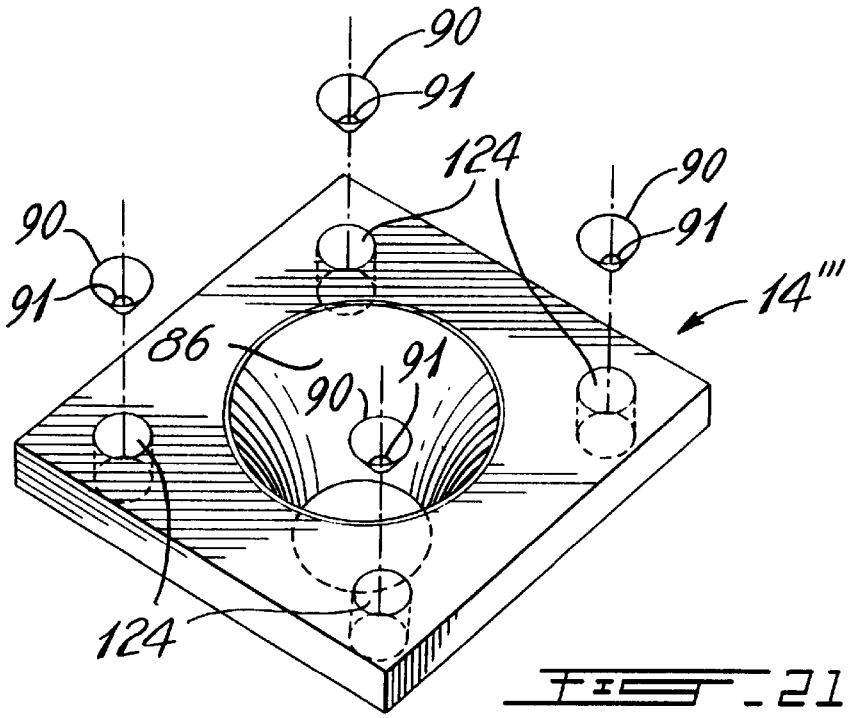
FIG. 21 is a schematic isometric view of a variant closure of that of FIG. 18.
Figure 25:
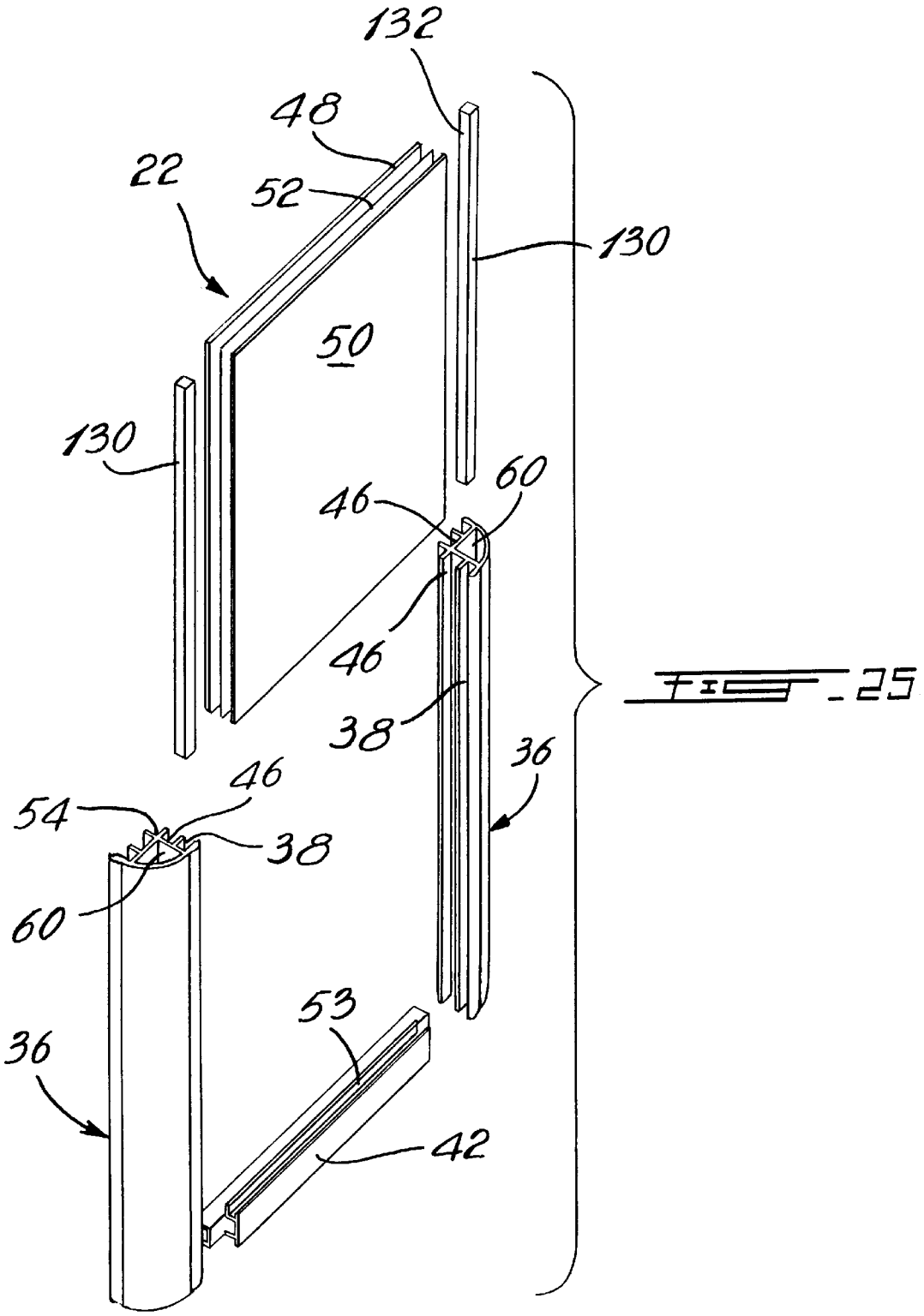
FIG. 25 is a schematic perspective exploded view of a variant of the outer container of FIGS. 6 and 7, wherein only one side thereof is shown.
Figure 27:
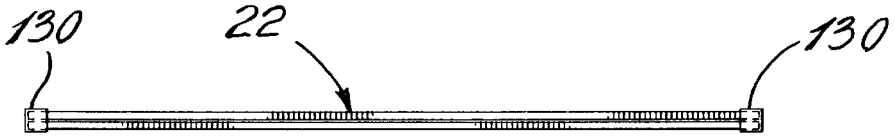
FIG. 27 is a schematic top plan view of the assembled side wall of FIG. 26.
Figure 26:
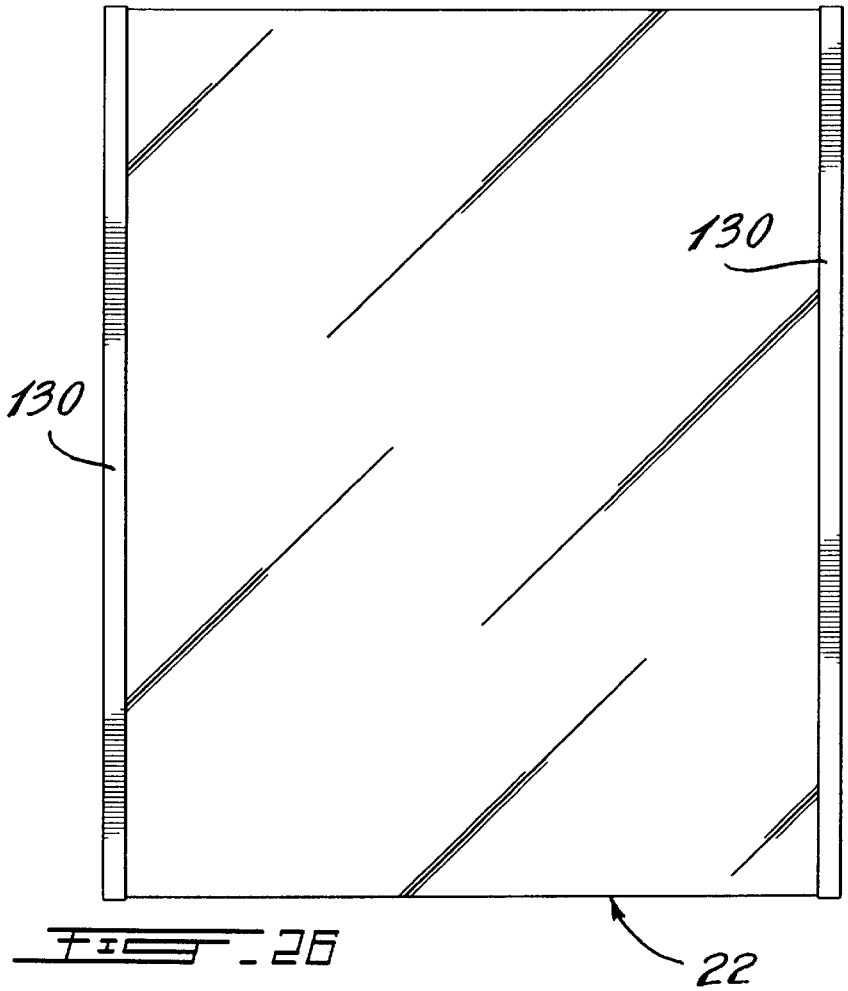
FIG. 26 is a schematic elevational view of the assembled side wall of FIG. 25.
Figure 28:
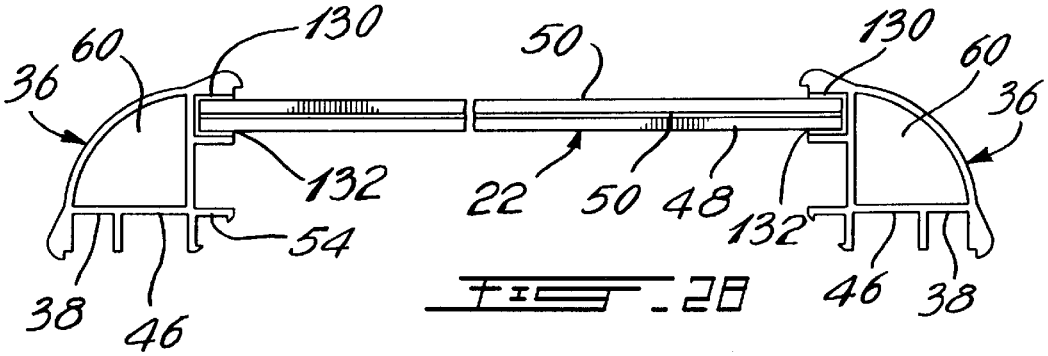
FIG. 28 is a schematic top plan view of the side wall of FIGS. 26 and 27 in mounted position to a pair of side posts.

FIG. 21 schematically illustrates the removable ashtray covers 90 previously shown in FIG. 9 and which are installed onto the cylindrical ashtrays 124, the ashtrays 124 being removable from the closure 14''' so that they can be emptied. The ashtrays 124 and especially the visible ashtray covers 90 can have various shapes, namely cylindrical, square, conical, etc. Obviously, complementary recesses are defined in the closure 14''' for receiving the ashtrays 124.

FIGS. 22 to 24 illustrate details of the ashtrays 88 of FIG. 8 which, in FIGS. 22 to 24, communicate with conduits 60 of the posts 36 by way of openings in the posts 36 near the bottom of the ashtrays 88 (similarly to the openings 120 of FIG. 18) such that ashes and cigarette butts deposited in the ashtrays 88 end up at the bottom of the conduits 60 of the posts 36. In the illustrated embodiment, arcuate rectangular openings 126 are defined at the lower ends of the posts 36 with a guillotine door 128 being slidably mounted to the posts 36 such as to vertically reciprocate therealong for opening and closing the guillotine door 128. Obviously, when the guillotine doors 128 are in their raised open position, access is provided to the conduits 60 of the posts 36 by way of the openings 126 thereof for the removal of the ashes and cigarette butts which have accumulated at the bottom of the conduits 60. It is noted that the guillotine doors 128 follow the contour of the facades of the posts 36.

FIGS. 25 to 28 illustrate a pair of identical braces 130 for holding together the various layers of each side wall 22, i.e. the inner and outer panels 48 and 50 and the intermediate panel or sheet 52 disposed therebetween. Each brace 130 has the shape of an elongated substantially rectangular channel having end walls at its opposed longitudinal ends; in other words, the brace 130 is a five-sided elongated structure having an open end at 132 for receiving the side wall 22. Two braces 130 are required for each side wall 22, that is along both vertical side edges thereof such as to retain the panels 48, 50 and 52 in a sandwich-like configuration (see FIGS. 27 to 29). Once the braces 130 are assembled to the side wall 22, they are, with the vertical edges of the side wall 22, slidably received in the channels 38 defined in the posts 36 (see FIG. 28) while the lower horizontal edge of the side wall is received in the upper channel 53 defined in the lower beam 42.

Accordingly, it is easily seen from the foregoing that the various trash receptacles of the present invention are ergonomic and of simple and sturdy construction while in some cases substantially preventing access to the garbage contained in the trash cans thereof by people other than city workers. Furthermore, the trash receptacles allow for various advertisements to appear thereon and which can be easily changed, but only by authorized personnel and, more particularly, by persons which can unlock both the closure 14 and the locking bars 82 from the box-like housing 10 of the outer container C. Some of the present trash receptacles are provided with easily replaceable components which, when an outer, i.e. visible, surface of the outer container is damaged, can be removed and replaced rapidly and economically. Moreover, the present trash receptacles are designed to impede the spreading of fires ignited therein. Ashtrays can also be provided, for instance, atop the closure or on the sides of the corner posts. The trash cans can define distinct compartments for receiving selected items, in which case dedicated doors are provided on the closure for each compartment.

I claim:

1. A receptacle comprising an outer housing and an inner container located in said housing, said housing defining an opening such that matter deposited therethrough is collected in said inner container, wherein said housing comprises an inner structural frame and side walls adapted to be removably mounted thereto, said housing also comprising outer decorative members detachably mounted to said inner structural frame, said inner structural frame having post means and cross member means adapted to be assembled such as to form said inner structural frame, said outer decorative members each defining a visible surface thereby allowing for the easy replacement of any outer decorative member in the event of damage to the visible surface thereof.

2. A receptacle as defined in claim 1, wherein said post means and said cross member means are completely hidden by said outer decorative members .

3. A receptacle as defined in claim 2, wherein said outer decorative members and said inner frame define cooperating engagement means for detachably securing said outer decorative members to said inner frame, wherein said engagement means are completely concealed by said outer decorative members when the latter are assembled to said inner frame.

4. A receptacle as defined in claim 3, wherein said inner frame and said outer decorative members are extrusions.

5. A receptacle as defined in claim 3, wherein said engagement means comprise tongue and groove means provided on one and the other of said inner frame and said outer decorative members.

6. A receptacle as defined in claim 1, wherein said side walls each comprise at least inner and outer panels slidably engaged between a pair of adjacent post means, brace means being provided for holding said inner and outer panels together along side edges thereof even when removed from said post means.

7. A receptacle comprising an outer housing and an inner container located in said housing, said housing defining an opening such that matter deposited therethrough is collected in said inner container, said housing comprising ashtray means distinct from said inner container, wherein further matter deposited in said ashtray means remains separate from said inner container, and wherein said housing comprises at least one hollow elongated member defining an inner compartment distinct from said inner container, said ashtray means communicating with said inner compartment, whereby matter deposited in said ashtray means discharges in said inner compartment such as to accumulate therein.

8. A receptacle as defined in claim 7, wherein said housing comprises an upper closure, said upper closure defining said opening and said ashtray means being provided on a horizontal surface of said closure.

9. A receptacle as defined in claim 7, wherein said housing comprises vertical posts with at least one of said posts defining said elongated member and said inner compartment, said ashtray means being adapted to be mounted at an upper end of said elongated member with said matter depositing at a bottom end thereof, access means being provided at said bottom end of said elongated member for allowing said inner compartment to be emptied.

10. A receptacle as defined in claim 9, wherein an opening means is defined at said bottom end of said elongated member with said access means comprising a normally closed door located in said compartment means and opposite said opening means such as to close the latter.

11. A receptacle as defined in claim 9, wherein an opening means is defined at said bottom end of said elongated member with said access means comprising a slidable guillotine-type door slidably mounted on an outer surface of said elongated member and adapted to be selectively displaced such as to open or close said opening means.

12. A receptacle as defined in claim 9, wherein said ashtray means is mounted externally of said elongated member with communicating second and third opening means being defined respectively in said elongated member and said ashtray means such that the matter deposited in said ashtray means accesses said inner compartment.

13. A receptacle as defined in claim 7, wherein decorative ashtray cover means are removably provided on said ashtrays such as to conceal said ashtrays, said cover means being adapted to communicate with said ashtrays such that matter deposited in said cover means deposits in said ashtrays, whereby said cover means conceals the matter accumulated in said ashtrays.

14. A receptacle as defined in claim 1, wherein said housing comprises conduit means in communication with said opening such that matter deposited through said opening is conveyed by said conduit means towards said inner container, said conduit means including a concavely frustoconical side wall.

15. A receptacle as defined in claim 14, wherein said housing comprises an upper closure, said opening being defined in said upper closure with said conduit means extending downwardly therefrom.

16. A receptacle as defined in claim 1, wherein said inner container comprises at least two separate compartment means for receiving distinct types of matters.

17. A receptacle as defined in claim 16, wherein said housing comprises an upper closure, said upper closure defining at least one said opening for each of said compartment means, wherein each opening is associated with one compartment means.

18. A receptacle as defined in claim 17, wherein said closure is provided with door means for closing each said opening, indicia being provided for associating said door means with said compartment means.

* * * * *